United States Patent [19]

Rauschert et al.

[11] Patent Number: 4,512,530

[45] Date of Patent: Apr. 23, 1985

[54] APPARATUS FOR HANDLING SPLIT-BATT ROLLS

[75] Inventors: William C. Rauschert, Montgomery, Tex.; Leo A. Oswald, Huntingdon, Pa.

[73] Assignee: Owens-Corning Fiberglas Corporation, Toledo, Ohio

[21] Appl. No.: 588,618

[22] Filed: Mar. 12, 1984

[51] Int. Cl.[3] ..... B65H 17/00

[52] U.S. Cl. ..... 242/67.3 R; 242/68.7

[58] Field of Search ..... 242/67.3 R, 56.1, 67.1, 242/78.7, 68.7; 156/584

[56] References Cited

U.S. PATENT DOCUMENTS 2,276,297 3/1942 Flood ..... 242/67.3 R
3,223,344 12/1965 Weymouth ..... 242/78.7
3,360,210 12/1967 Frisbie ..... 242/67.3 R
3,415,706 12/1968 Ettre ..... 156/584 X
4,120,463 10/1978 Alinder et al. ..... 242/67.3 R X

*Primary Examiner*—John M. Jillions
*Assistant Examiner*—Leo J. Peters
*Attorney, Agent, or Firm*—Ronald C. Hudgens; Philip R. Cloutier; Paul J. Rose

[57] ABSTRACT

The apparatus includes a plurality of small rollers disposed in an arcuate, upwardly concave arrangement for rotatably supporting a composite two-batt roll, a large rotating roller for winding up one of the batts while the other is pulled intermittently from the composite roll for use, and a stationary bar engaging the one batt being rewound to prevent the rotating large roller from pulling the one batt from the composite roll independently of the pulling of the other batt.

3 Claims, 2 Drawing Figures

APPARATUS FOR HANDLING SPLIT-BATT ROLLS

TECHNICAL FIELD

This invention relates generally to apparatus for handling split-batt rolls, and more particularly to apparatus for handling essentially two glass wool batts wound together in a single supply roll, whereby a lower or outer batt may be intermittently pulled from the supply roll and an upper or inner batt from the supply roll is rewound into a separate roll for use subsequent to exhaustion of the original two-batt supply roll. The invention is particularly useful in the manufacture of flexible insulated air duct.

BACKGROUND ART

Flexible insulated air duct may include a core of a wire helix encapsulated in plastic film duct liner, glass wool insulation wrapped around the core, and a plastic film sleeve over the insulation. Duct length may be as long as twenty-five feet. Before this invention, the glass wool used was of the type produced by the apparatus disclosed in U.S. Pat. No. 3,865,566, issued Feb. 11, 1975. That is, because twenty-five feet of the wool had to be pulled from the roll each time, it was thought best to use wool having glass fibers oriented mainly longitudinally of the batt, for greater strength and less pulling apart. In actual practice, fiberizing apparatus of the type shown in the above patent includes only two or three spinners, and glass throughput and conveyor speed are relatively low. Therefore, the wool batts with longitudinally oriented glass fibers are relatively expensive. Even so, before this invention, it was not thought that wool batts with randomly oriented fibers would be strong enough not to pull apart when twenty-five or more feet were pulled off a roll.

Glass wool batts with randomly oriented glass fibers are made by apparatus such as disclosed in U.S. Pat. No. 3,523,774, issued Aug. 11, 1970. In actual practice, such fiberizing apparatus has a large number of spinners in order that relatively thick blankets of building insulation can be made at relatively high conveyor speeds. These conveyor speeds are already so high that it is impractical to attempt to run the conveyor at even higher speeds to produce relatively thin glass wool batts for flexible insulated air duct. The solution was to split the blanket or batt. Thus, for example, it is practical to make a batt nominally three inches thick and to split it into two batts of one and one-half inch thickness before roll-up. The apparatus of this invention is designed for use of such "two batts in one roll" supply rolls in the manufacture of flexible insulated air duct.

DISCLOSURE OF INVENTION

In accordance with the invention, apparatus is provided for rotatably supporting a "two batts in one roll" supply roll at a lower portion of its circumference whereby a radially outer batt may be pulled intermittently from the supply roll, and for rewinding a radially inner batt into a separate roll for temporary storage on a roller which is continuously rotating, without subjecting the radially inner batt to excessive tension longitudinally or excessive compression radially.

BRIEF DESCRIPTION OF THE DRAWINGS

The invention is more fully described hereinafter with reference to the accompanying drawings wherein.

BEST MODE OF CARRYING OUT THE INVENTION

Figures 1, 2:
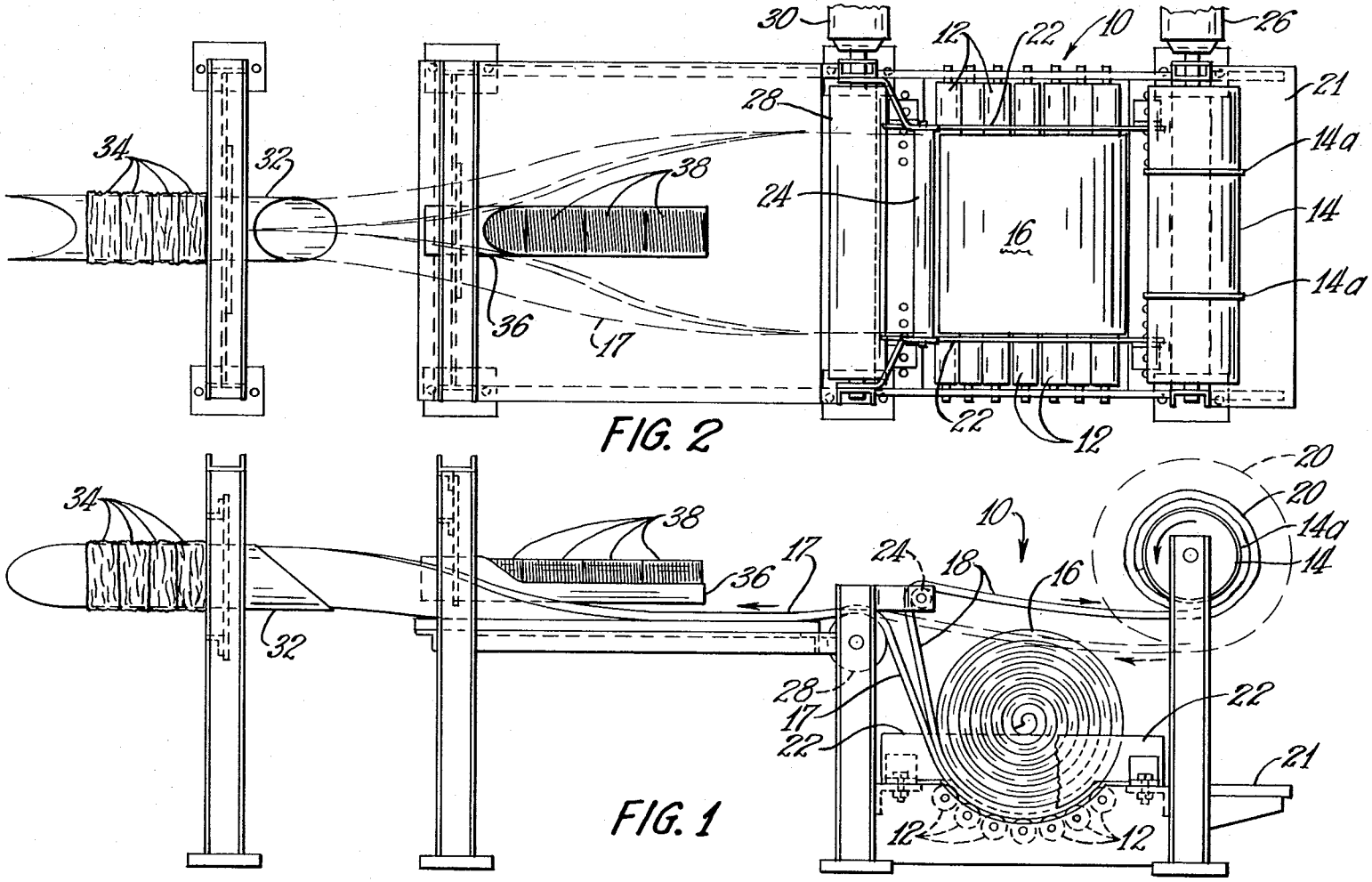
FIG. 1 is an elevational view of handling apparatus constructed in accordance with the invention and shown in association with a portion of a flexible insulated air duct manufacturing line.
FIG. 2 is a plan view of the apparatus of FIG. 1.

With respect to the drawings, FIGS. 1 and 2 show handling apparatus 10 constructed in accordance with the invention. The apparatus 10 includes suitable framework for rotatably mounting a plurality of rollers 12 of relatively small diameter in a generally arcuate upwardly concave arrangement and for rotatably mounting a roller 14 of relatively large diameter in operationally suitable relationship with the rollers 12. In operation, the rollers 12 rotatably support a composite roll 16 of two batts of glass wool insulation wound together. A radially outer batt 17 of the roll 16 is pulled intermittently therefrom in a flexible insulated air duct manufacturing process while a radially inner batt 18 of the roll 16 is rewound into a separate roll 20 on the roller 14. The relatively large roller 14 is disposed generally rearwardly of the rollers 12 for the convenience of an operator in making the first wrap of the batt 18 in the roll 20 therearound. While doing this, the operator may step up on a step or platform 21. The composite roll 16 is loaded onto the rollers 12 by rolling it across the platform 21. For this reason, the roller 14 must be high enough above the platform 21 to provide clearance for a full composite roll 16. Guideplates 22 are provided for centering the roll 16.

The batt 18 is fed from the roll 16 around a suitably mounted stationary round bar 24 before being wound on the roller 14. A motor 26 is provided for continuously rotating the roller 14 until the composite roll 16 is used up. The roller 14 is sufficiently large to establish frictional driving engagement with the batt 18 as long as there is any slack therein, yet not large enough to maintain frictional driving engagement therewith after no slack remains. The non-rotatable bar 24 operatively engages the batt 18 and insures that after no slack remains therein, the roller 14 does not pull the batt 18 from the roll 16 independently of the pulling of the batt 17 therefrom. A pair of spaced circular collars **14*a* preferably formed from square bar stock are welded in place on the roller 14 to inhibit movement of the roll 20 endwise of the roller 14**.

The batt 17 is periodically pulled from the roll 16 twenty-five feet at a time. It is pulled over an assist roller 28 continuously driven by a motor 30 and into a forming shoe 32 by which it is curled into a circular shape. Jacket material 34 is mounted on the downstream end of the forming shoe 32. The jacket material 34 may be a twenty-five foot long sleeve of plastic film gathered up on the pipe-like downstream end of the forming shoe 32. Restraining means (not shown) holds the jacket material 34 and prevents it from coming off the forming shoe 32 all at once, whereby it is stretched out as it is pulled off. A core magazine 36 holds a supply of previously formed gathered up cores 38 each comprising wire helix encased in plastic film and cut to twenty-five foot lengths when extended. Restraining means (not shown) is provided on the core magazine 36 to cause a core 38 to be stretched out as it is pulled out of the magazine. A core 38 is fed into the batt 17 ahead of the forming shoe 32. The core 38, batt 17, and jacket material 34 are all pulled at once from the downstream end of the forming shoe 32 to complete a duct length, after which the batt 17 is cut to length.

The pulling of the core 38, batt 17, and jacket material 34 is interrupted with a trailing end of the intended duct length still in the forming shoe 32. An operator then pulls another core 38 partly out of the core magazine 36 and positions the leading end in the forming shoe with. the batt 17 wrapped therearound. The pulling of the first core 38, batt 17, and jacket material 34 is then completed, leaving the leading end of the second core 38 adjacent the exit from the forming shoe 32, handy for pulling the next duct length.

After the composite roll 16 is exhausted, the batt 18 may be used from the rewound roll 20, being pulled over the roller 28 but under the non-rotatable bar 24, and the motor 26 being shut off.

Various modifications may be made in the structure shown and described without departing from the scope of the invention.

We claim:

1. Handling apparatus for composite two-batt rolls of glass wool insulation, said apparatus comprising a plurality of rotatably mounted rollers of relatively small diameter disposed in a generally arcuate upwardly concave arrangement, a rotatably mounted roller of relatively large diameter disposed in suitably spaced relationship with the plurality of rollers of relatively small diameter, means for continuously rotating the large-diameter roller, and a non-rotatable bar disposed in suitably spaced relationship with the large-diameter roller, the large-diameter roller being sufficiently large to establish frictional driving engagement with a first winding of a batt of glass wool insulation wrapped therearound as long as there is slack in a following portion of the batt to be wound, whereby glass wool insulation in the form of two batts wound together in a composite roll may be rotatably supported along a lower portion of the periphery of the composite roll by the plurality of rollers of relatively small diameter and a radially outer batt of the composite roll may be intermittently pulled therefrom while a radially inner belt of the composite roll is wound into a separate roll on the rotating large-diameter roller, the non-rotatable bar operatively engaging the inner batt during the winding thereof on the large-diameter roller and insuring that, after no slack remains therein, the large-diameter roller does not pull the inner batt from the composite roll independently of the pulling of the outer batt therefrom.

2. Handling apparatus as claimed in claim 1 wherein the large-diameter roller is a smooth-surfaced steel roller.

3. Handling apparatus as claimed in claim 2 including a pair of spaced collars on the large-diameter roller tending to prevent shifting of the first winding of the rewound inner batt axially of the roller.

* * * * *